US010118380B2

(12) United States Patent
Feygelman

(10) Patent No.: US 10,118,380 B2
(45) Date of Patent: Nov. 6, 2018

(54) SEALING

(71) Applicant: HEWLETT-PACKARD INDIGO B.V., Amstelveen (NL)

(72) Inventor: Alex Feygelman, Petach-Tiqwa (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/541,271

(22) PCT Filed: Jan. 29, 2015

(86) PCT No.: PCT/EP2015/051826

§ 371 (c)(1),
(2) Date: Jun. 30, 2017

(87) PCT Pub. No.: WO2016/119857

PCT Pub. Date: Aug. 4, 2016

(65) Prior Publication Data

US 2017/0348964 A1 Dec. 7, 2017

(51) Int. Cl.

| | |
|---|---|
| ***B41F 19/00*** | (2006.01) |
| ***B41J 11/00*** | (2006.01) |
| ***G03G 15/00*** | (2006.01) |

(52) U.S. Cl.

CPC ..... *B41F 19/002* (2013.01); *B41J 11/0015* (2013.01); *G03G 15/6582* (2013.01)

(58) Field of Classification Search

CPC . B41J 11/0015; B41F 19/002; G03G 15/6582
See application file for complete search history.

(56) References Cited

U.S. PATENT DOCUMENTS

| | | | |
|---|---|---|---|
| 4,606,495 | A | 8/1986 | Stewart et al. |
| 5,105,758 | A | 4/1992 | Kozak |
| 6,824,828 | B2 | 11/2004 | Su et al. |

FOREIGN PATENT DOCUMENTS

| | | |
|---|---|---|
| EP | 1491338 | 12/2004 |
| GB | 759132 | 10/1956 |
| GB | 1112443 | 5/1968 |
| JP | H09225372 | 9/1997 |
| WO | WO-2013020560 | 2/2013 |

OTHER PUBLICATIONS

AquaSEAL Superwide Liquid Laminators. (n.d.). Retrieved Jun. 29, 2017, from https://globalgarage.com/media/25070/642/specsheet.pdf.

*Primary Examiner* — Lamson Nguyen
(74) *Attorney, Agent, or Firm* — HP Inc. Patent Department

(57) ABSTRACT

Certain examples of seals that can move along a slit are disclosed. The seals can comprise a first leaf, a second leaf, and a biasing member to push the first leaf away from the second leaf. Also, apparatus for applying a fluid, and printing systems are described.

19 Claims, 6 Drawing Sheets

SEALING

CROSS-REFERENCE TO RELATED APPLICATION

This application is a U.S. National Stage Application of and claims priority to International Patent Application No. PCT/EP2015/051826, filed on Jan. 29, 2015, and entitled "SEALING".

BACKGROUND

Some printing technologies employ a special substrate coating or a priming treatment prior to the application of ink or toner. Generally this kind of treatment is performed at a stage when a print medium or substrate is fed from a roll, e.g. before cutting operations. Applying a priming treatment in this manner helps the treatment process to be stable and continuous. However, there are cases when a priming treatment is better applied to cut sheets of print media or substrate. For example, this may be the case for thick substrates or for cases where a priming fluid is applied shortly before ink application for better ink adhesion. There are also cases where a print medium or substrate may vary in shape and/or size. For example, in a printing system with a variable cut sheet size, a substrate coating may be applied to varying sizes of sheet.

BRIEF DESCRIPTION OF THE DRAWINGS

Some non-limiting examples of the present disclosure will be described in the following with reference to the appended drawings, in which.

DETAILED DESCRIPTION

Certain examples as described herein provide an apparatus for use in a printing system or in combination with a printing system. In particular, certain examples enable the application of a fluid to substrates of varying sizes. In one case, an apparatus is provided that enables a fluid to be applied to substrates of varying widths. In this case, an aperture or slit of the apparatus has an adjustable width, wherein a fluid may be applied to a substrate, e.g. by way of a transfer member, using the aperture. In one case, the aperture is provided in a closed or pressurized chamber, between a pair of lateral seal assemblies. At least one of the lateral seal assemblies can be moveable along an axis of the pressurized chamber to adjust the width of the aperture. The movable lateral seal assembly may comprise an aperture seal arranged to move along the aperture and a piston seal to move within the chamber. The aperture seal may comprise an upper leaf, and a lower leaf, wherein the upper leaf is pushed into contact with the upper edge and the lower leaf is pushed into contact with the lower edge.

Figure 1:
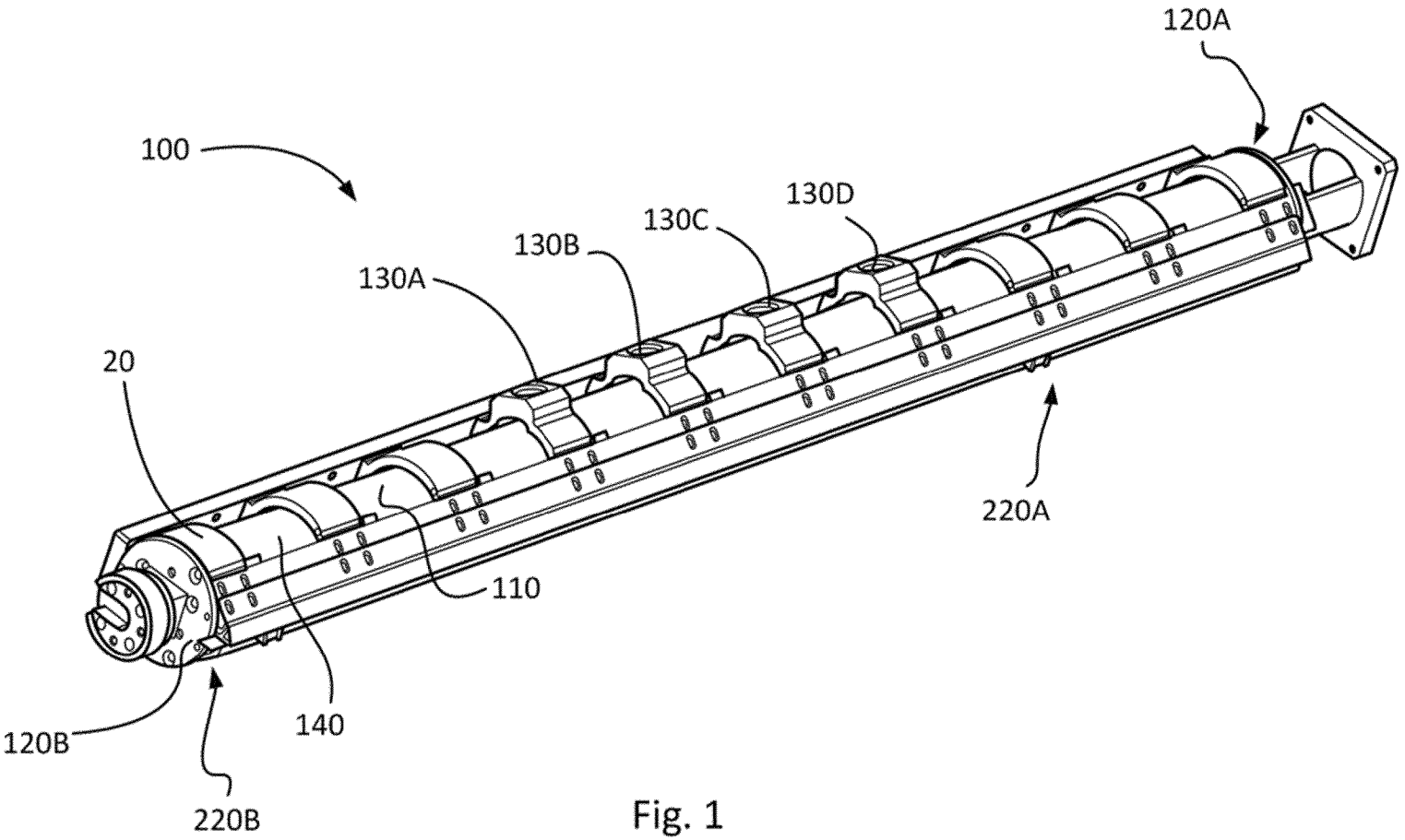
FIG. 1 is a schematic drawing showing a perspective view of an apparatus for applying a fluid to a print medium in a printing system according to an example.

FIG. 1 shows a perspective view of an apparatus 100 according to an example. The apparatus 100 comprises a chamber 110. In use the chamber 110 is formed inside a housing 140. The chamber 110 is arranged to receive a fluid. This fluid may comprise a priming fluid or substrate coating, e.g. a fluid suitable for application in a printing process. It may comprise a fluid for pre or post treatment of an item, e.g. a primer or varnish. In certain cases the fluid is a liquid. In FIG. 1, the chamber 110 is substantially closed but comprises an elongated aperture or slit through which the fluid may exit, as further explained below.

Priming fluids and other fluids can have an aggressive nature, e.g. they can have a low pH. Additionally, fluids in apparatus such as printing apparatus can be damaging in other ways, for example when they dry up or when they are supplied in too large amounts. Appropriate control of the application of such fluids and sealing can thus improve the functionality or performance of such apparatus.

In FIG. 1, the housing 140 is mounted with a plurality of brackets 120. A selection of these brackets can comprise a fluid supply nozzle 130A-130D. Although not visible, corresponding holes are provided in the housing 140. The fluid supply nozzles 130 may be spaced to allow uniform filling of the chamber with the fluid. An additional air evacuation aperture may also be provided for clogged air evaluation. In certain cases a low pressure or vacuum may be applied to the air evacuation aperture to aid air outflow from the chamber and uniform fluid filing. Application of a low pressure or vacuum can also enable full filling of the chamber volume without fluid dripping from an aperture of the chamber.

The chamber 110 of FIG. 1 extends along an axis and is mounted between a first mounting bracket 120A and a second mounting bracket 120B. The two mounting brackets 120 form a mounting that sets the position of the chamber 110 within a printing system. In one implementation, the chamber 110 may extend across a width of a media transport system within the printing system. In the example of FIG. 1, the first mounting bracket 120A is further arranged to support a motor. The use of the motor will be described later below.

In one implementation, the internal chamber surfaces, e.g. the internal surfaces of housing 140 may be covered with a flexible inner sheet arranged on the inside of the outer housing to protect the outer housing from the fluid. The flexible inner sheet may be made of e.g. stainless steel that is resistant to the erosive or corrosive nature of the fluid. The outer housing 140 could thus be made of a relatively cheap material, for example a plastic such as PVC. This can enable easy manufacture and assembly, as the outer housing may be made of a relatively cheap material and may be manufactured by extrusion. Extrusion is able to provide good manufacturing tolerances so that the height of the slit can be maintained sufficiently constant over the entire length of the chamber. The flexible inner sheet may be made of a material able to resist e.g. high or low pH of the fluid. The housing 140 can be attached to a plurality of mounting brackets 20 as will be described later on below. The mounting brackets 20 are attached to base 10.

Figure 2:
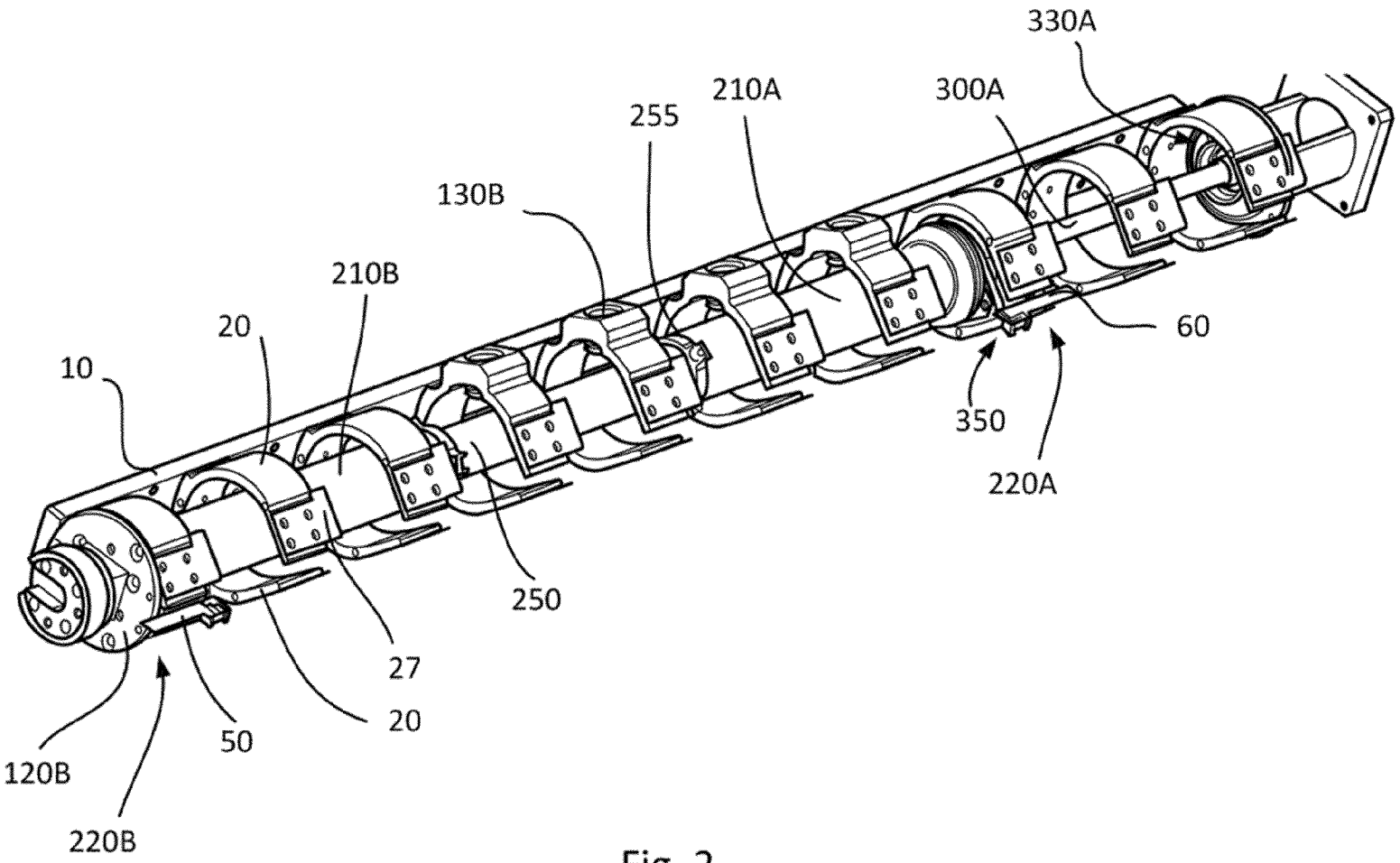
FIG. 2 is a schematic drawing showing a perspective view of part of the apparatus of FIG. 1 according to an example.

FIG. 2 shows the apparatus 100 of FIG. 1 with the housing 140 removed. This shows the interior of the chamber 110.

The lateral ends of the chamber 110 are defined by two lateral end seals 220. A first lateral end seal 220A seals the interior of the chamber 110 at a first end and a second lateral end seal 220B seals the interior of the chamber 110 at a second end.

In the example of FIG. 2 the lateral end seal assemblies 220A and 220B are coupled along the axis of the chamber 110 by a connecting part 250. The connecting part 250 may comprise a single portion or a number of distinct portions and extends along the length of the chamber 110 along the axis.

Figure 3:
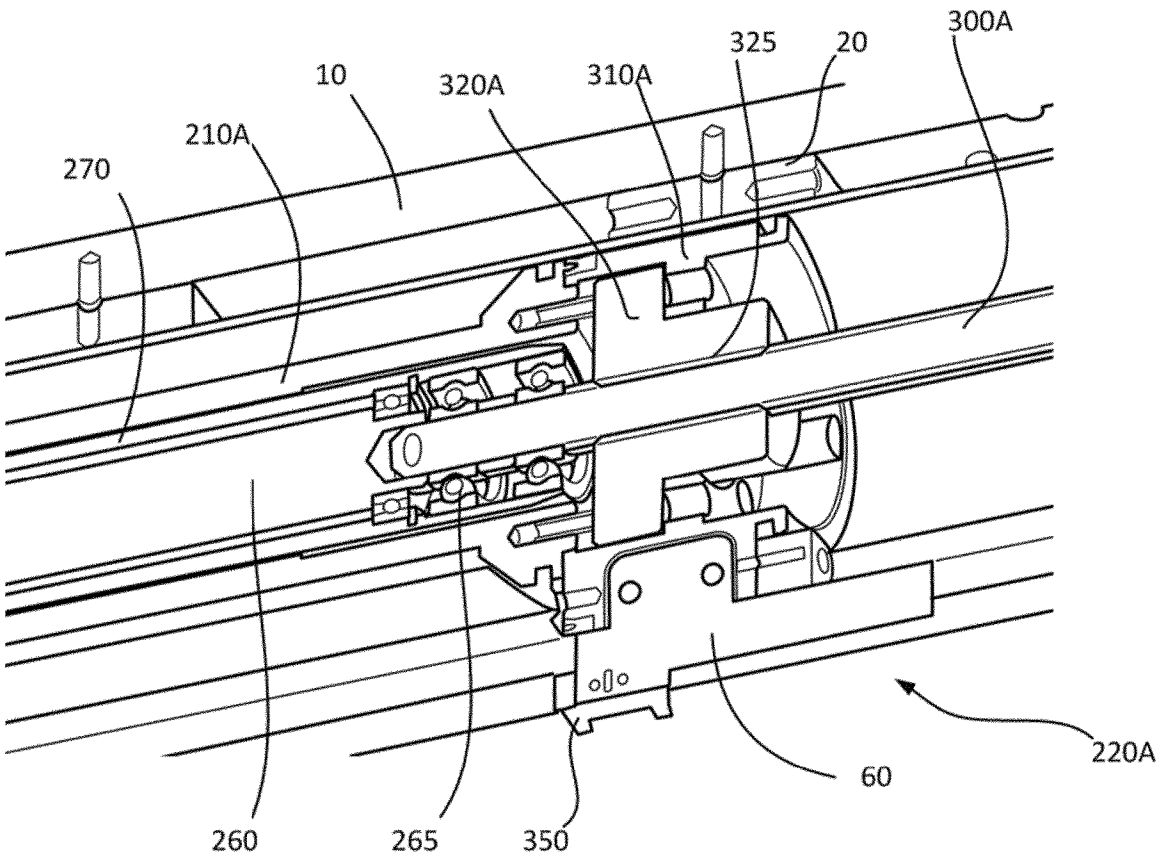
FIG. 3 is a schematic drawing showing a perspective view of a cross-section along an axis of the apparatus of FIG. 1 according to an example.

In FIG. 2, the shown portions of the connecting part 250 comprise two protecting sleeves 210A and 210B and a central co-axial sleeve 270 (see FIG. 3 for more detail). Each protecting sleeve 210A and 210B may be telescopic, e.g. the diameter of the sleeve may vary as the sleeve extends from a location of a lateral end seal to the center of the chamber 110.

As is described in more detail with reference to FIG. 3, in the present example the connecting part 250 allows a rotational movement to be transmitted from a motor at a location of one lateral end seal to a location of the other lateral end seal. In the example of FIG. 2, a centering clamp 255 is provided at a substantially central location along the length of the chamber 255. The centering clamp 255 supports the connecting part 250, i.e. provides a bush or support part that at one or more locations is coupled to, or rests on, the housing of the chamber 110 and that in the center supports the connecting part 250. Although only a single centering clamp 255 is shown in FIG. 2, in other examples a plurality of clamps may be provided and/or these may be provided at different points along the length of the chamber 110. The precise configuration of the transmission may depend on geometry and a configuration of the printing system.

FIG. 3 shows a cross-section of the chamber 110 at one end of the apparatus 100. The cross-section is taken along a vertical plane that contains the axis of the chamber 110. As seen in FIG. 3, lateral end seal 220A forms part of a linear actuator. The linear actuator is arranged to move the lateral end seal 220A along the axis of the chamber 110, e.g. towards the center of the chamber 110 and/or towards the mounting bracket 120A. The lateral end seal may comprise a piston seal moving along and within the chamber and an aperture seal moving along the aperture of the chamber. The linear actuator may be implemented in a variety of manners. In the example of FIG. 3, the linear actuator comprises a floating nut 320A that is mounted upon a lead screw 300A. The linear actuator is driven by a motor (not shown).

An axle of a motor may be coupled to the lead screw 300A such that rotation of the axle of the motor rotates the lead screw 300A. The threads 325 of the lead screw 300A and the floating nut 320A are configured such that rotation of the lead screw 300A is translated into linear movement of the floating nut 320A within the chamber 110. In the present example, the floating nut 320A forms part of the lateral end seal assembly 220A. In one case, the floating nut 320A may comprise a piston seal ring 310A together forming a piston seal such that a fluid in the chamber 110 cannot pass beyond the lateral end seal 220A. The lateral end seal assembly 220A in this case further comprises an aperture seal 60, which is further explained below.

In certain implementations each lateral end seal 220A may comprise a plurality of components that act to seal a lateral end of the chamber; this may differ from those illustrated in the Figures depending on requirements and printing system configuration. In another example, the linear actuator may be implemented using an air pressure piston with an appropriately configured stroke length. In some examples, both lateral seal assemblies may be movable, whereas in other examples, one of the lateral seal assemblies is movable, and the other lateral seal assembly is fixed.

Returning to FIG. 3, it can be seen that protecting sleeve 210A acts to seal the lead screw 300A from the interior volume of the chamber 110, such that fluid within the chamber does not interact with the components of the linear actuator. In the illustrated example, an annular sensor plate 330A (see FIG. 2) is arranged between the chamber 110 and the mounting bracket 120A. The annular sensor plate 330A may, for example, comprise a magnetic sensor that detects a proximity of floating nut 320A and/or a contact sensor that detects contact between a component of the floating nut 320A and the sensor plate. The annular sensor plate 330A enables configuration of the lateral end seals, for example they may be used during an initial set-up to determine when each end seal is at a "home" location that can be used as a reference for future motion.

In the illustrated example of FIG. 3, the lead screw passes through an aperture in the annular sensor plate 330A and an aperture in the mounting bracket 120A before being coupled to the axle of the motor at one end. At the other end of the lead screw 300A, there is a coupling between the lead screw 320A and a connecting rod 260.

The connecting rod 260 may extend between the end of the first lead screw 300A and an end of a second lead screw 300B that may form part of a linear actuator for the second lateral end seal 220B. The connecting rod may be rotatably coupled to each lead screw 300 such that rotation of the axle of the motor rotates both lead screws 300 and drives each linear actuator.

The configuration of the second lateral seal 220B may be similar to that of the first lateral end seal 220A, albeit with symmetrical mapping about the center of the chamber 110. The threads of the second lead screw 300B and the second floating nut 320B may be such that rotation of the axle of a motor causes symmetrical motion of each lateral end seal. For example, rotation of the axle of the motor in a first direction may move two floating nuts 320 towards the center of the chamber 110 while rotation of the axle of the motor in a second direction may move two floating nuts 320 towards respective mounting brackets 120. As can be seen, this means that rotation of the lead screws 300 in one direction, e.g. via the connecting rod 260, causes opposing linear motion of the floating nuts 300, as configured via respective threading configurations. In other examples, each linear actuator may be implemented separately; for example, the second lateral end seal 220A may be driven by a separate, independent motor or other alternative drive mechanism. In a similar manner to the protecting sleeves 210, the co-axial sleeve 270 surrounds the connecting rod 260 and seals the drive mechanism from fluid within the chamber 110.

The example described above provides an implementation of an apparatus with one or more adjustable end seals. Although two adjustable end seals are used in the described example, in an alternate case only a single end seal need be adjustable. Having one or more adjustable end seals allows the inner volume of a chamber to be adjusted and the fluid to be supplied precisely along a varying width of the print medium. A linear actuator can be used to move each end seal. In the described example, the linear actuator comprises a piston arrangement with a floating nut and a lead screw. In other examples, different linear actuator mechanisms may be used, including hydraulic pistons, rack and pinion systems and/or resilient members. In a case where the chamber 110 comprises an aperture, wherein each end of the aperture is defined by a lateral end seal, this adjustable volume may be used to provide an adjustable fluid application zone. Although an adjustable chamber has utility beyond fluid application, certain additional examples relating to fluid application are described below.

In an example as shown in FIG. 3, lateral end seal 220A further comprises a format limiter 350, further explained below.

Figure 4:
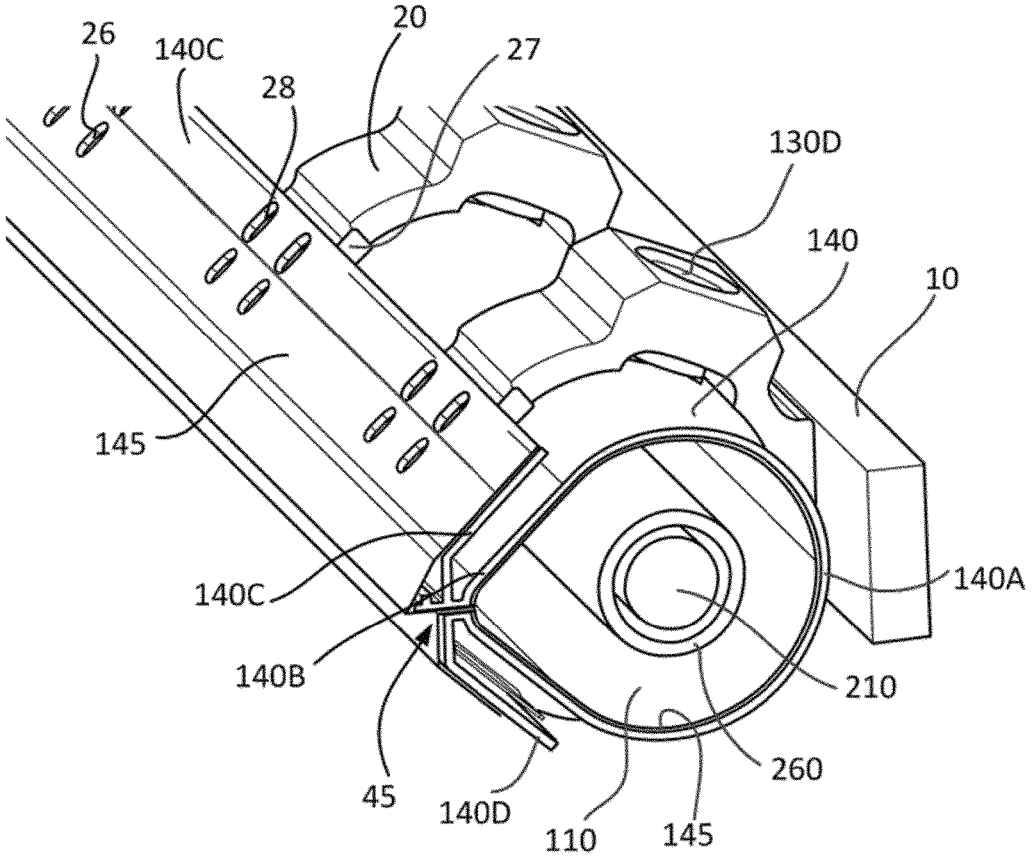
FIG. 4 is a schematic drawing showing a perspective view of a cross-section perpendicular to the axis of a fluid chamber of the apparatus of FIG. 1 according to an example.

FIG. 4 shows another schematic view of cross section of the chamber 110. This cross section is taken through a vertical plane that is perpendicular to the axis of the chamber 110. Chamber 110 as mentioned before is formed between connecting rod 260 and housing 140. Housing 140 in this example is shown to have a substantially drop-shaped cross-section with a substantially semi-circular portion 140A and a tapering portion 140B. The aperture of chamber 45 in this case is formed as a slit along the length of the chamber 110 and is formed at the apex of the tapering portion. An aspect of having a drop-shaped cross-section is that sharp angles can be avoided and this enables better sealing.

In the illustrated example, the housing further comprises an upper wing 140C and a lower wing 140D which are substantially parallel to the upper side and the lower side of the tapering portion 140B respectively. An inner flexible sheet 145 in this example is folded inside housing 140 so as to protect the housing 140. The ends of the flexible sheet extend through the aperture 45 and are folded back on the wings 140C and 140D.

To this end, the upper and lower wings 140C and 140D comprise a first row of mounting holes 26. Fasteners such as e.g. screws may be used to attach the flexible sheet 145 to the upper and lower wings. The upper and lower wings are shown to have a second row of mounting holes 28. Corresponding holes are provided in brackets 20. These rows of mounting holes 28 may be used to attach the upper and lower wings of housing 140 to brackets 20. Suitable fasteners, such as screws can be used. One or more spacers 27 may be used in some or all of the brackets. With such spacers, the exact distance between the upper and lower wings and thereby the height of the slit can be adjusted at each of the brackets. Variations in height of the slit that can be caused by manufacturing tolerances may thus be corrected. Furthermore, the same apparatus may be used with different fluids, e.g. fluids with different viscosities and in different printing applications. For each of these cases, a different height of the slit may be desirable. The spacers 27 may be used for this purpose.

Figure 5:
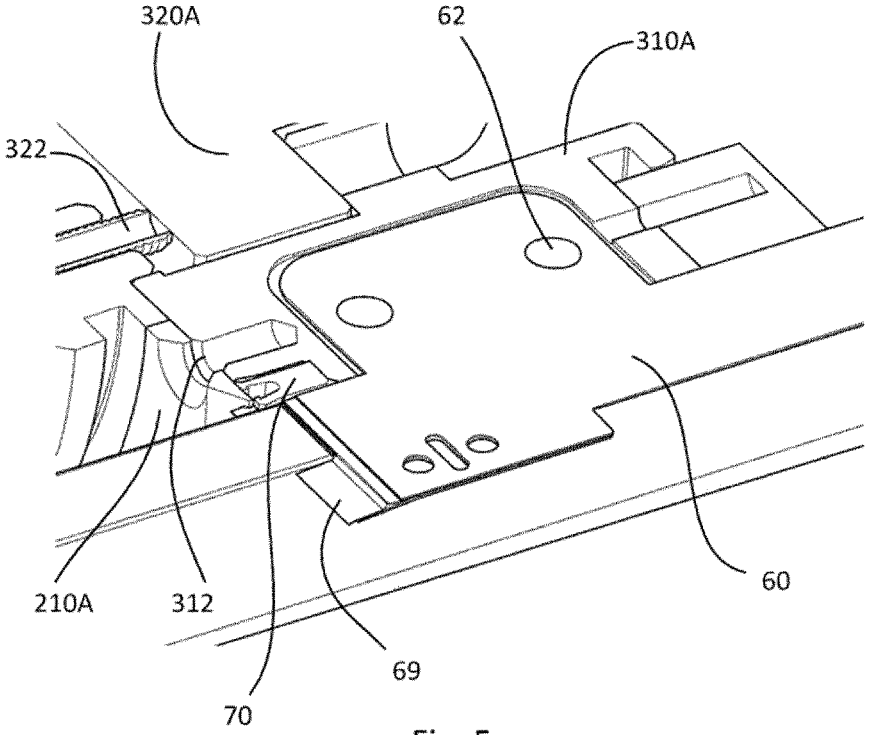
FIG. 5 is a schematic drawing showing a perspective top view of a cross-section of a seal of the apparatus of FIG. 1 according to an example.
Figure 6:
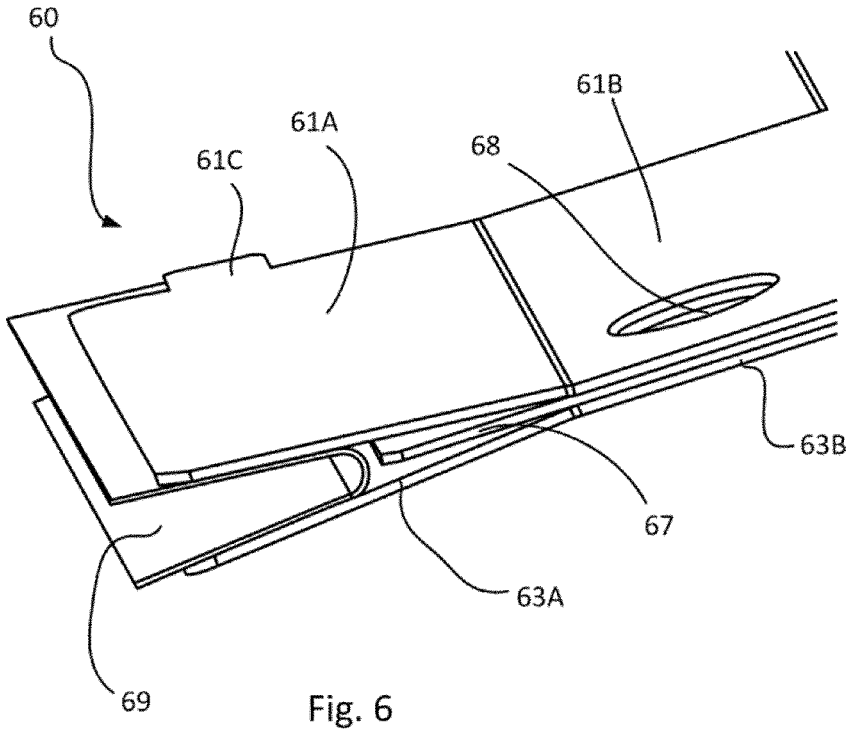
FIG. 6 is a schematic drawing showing a close-up view of a seal according to an example.

FIGS. 5 and 6 show a top view of a cross-section and an isometric view of an aperture seal 60. The aperture seal is connected to piston seal ring 310A with fasteners 62. This piston seal ring 310A forms a piston seal together with floating nut 320A as discussed before. A substantially drop-shaped seal line 70 forms part of the same piston seal.

The piston seal ring 310A and floating nut 320A are attached to protective sleeve 210A. Upon actuation of the floating nut, the piston seal moves along chamber 110 within housing 140. Hence, a width of the aperture of the chamber 110 is set by varying the position of each lateral end seal along the axis of the chamber, thus either increasing or decreasing the width along which fluid is supplied onto a print medium, e.g. via a transfer member. As the piston seal ring moves through the interior of the housing 140, aperture seal 60 moves along the aperture. This aperture seal is to avoid liquid penetration from the chamber 110 to a location upstream of the aperture edge, e.g. by capillary action. In certain alternative examples, the aperture seal 60 could be directly coupled to the floating nut 320A.

The aperture seal 60 of FIG. 6 has an upper leaf 61 and a lower leaf 63. A biasing member in the form of a folded V-shaped shim 69 is arranged between an end of the upper leaf 61A and an end of the lower leaf 63A, which act as upper and lower leaf spring blades respectively. The shim 69 pushes the first leaf and the second leaf away from each other. As the aperture seal is moved along the slit, the upper leaf is forced into contact with an upper edge of the slit, while the lower leaf is forced into contact with a lower edge of the slit. Along the width of the slit, there may be slight variations in height due to manufacturing tolerances. As the biasing member forces the upper leaf and lower leaf away from each other, sealing contact can be maintained both along the upper edge and the lower edge in spite of such variations. Also, in case of different fluids or different printing applications, it may be desirable to set a different height for the aperture. The aperture seal 60 also allows for such a change.

In examples, the V-shaped shim 69 may be made from polyamide and may be glued to the upper leaf spring blade and the lower leaf spring blade.

In the illustrated example, the aperture seal is formed by a sandwich of upper leaf 61, lower leaf 63 and a middle leaf 67. An aspect of having a middle leaf 67 is that a default minimum distance between upper and lower leaf 61 and 63 is easily achieved. Such a default minimum distance can be made to correspond to a minimum height of the slit minus the thickness of the upper and lower leaves. A further aspect of the middle leaf 67 is that it provides a positioning aid for the assembly of the shim 69. Yet a further aspect of the middle leaf is that the preload of the upper leaf and lower leaf can be reduced by an increased thickness of the middle leaf. The upper, lower and middle leaf of the aperture seal can be connected with a fastener arranged in fastener hole 68. In other examples, the aperture leaf does not necessarily comprise a middle leaf.

Side protrusion 61C is shown in FIG. 6 which is complementary to drop-shaped seal line 70. The seal line 70 can thus be arranged in front of the protrusion (i.e. in the figure, to the left of the protrusion).

Figure 7:
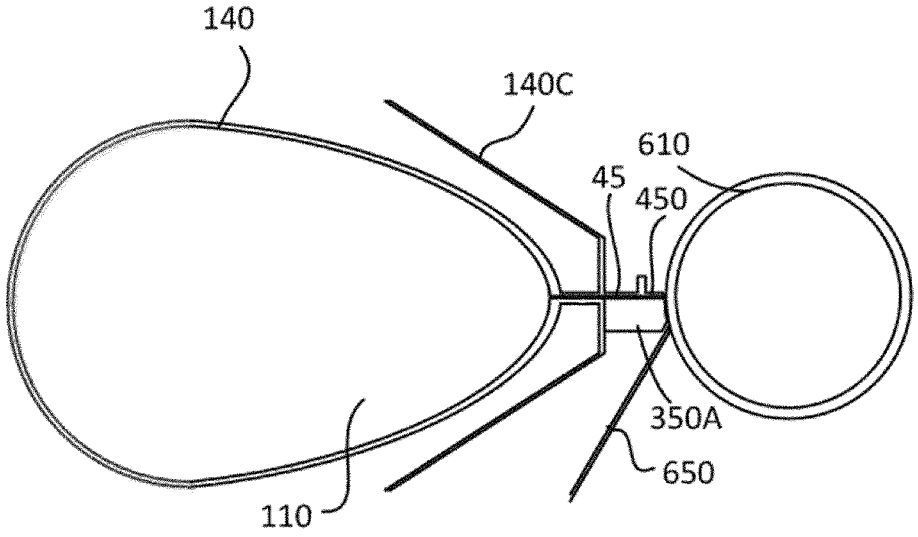
FIG. 7 is a schematic drawing showing a lateral cross-section of an apparatus for applying a fluid to a transfer member and a transfer member according to an example.

FIG. 7 shows the apparatus 100 in situ in a printing system. FIG. 7 is a perspective cross-section through a plane perpendicular to the elongate axis of the chamber 110.

In a general case, the printing system may comprise a transfer member that acts to transfer fluid from the chamber 110 to a print medium or substrate. There may be one or more transfer members, e.g. a plurality of transfer members may be used to complete the transfer of fluid from the chamber to the substrate. In other cases there may be no transfer member, e.g. the fluid may be applied directly to a substrate via the previously described variable width chamber. In any case, transfer of the fluid within the chamber 110 to a substrate occurs. In one example, the fluid may comprise a primer, i.e. a priming solution, or a treatment liquid to be applied to the substrate before the deposit of ink.

In the example of FIG. 7, the transfer member comprises an anilox roller 610, e.g. a cylinder upon a surface of which fluid is deposited, the fluid then being transferred to a substrate by way of rotation of the cylinder. In one case this is achieved using a further application roller (not shown) that receives fluid from the anilox roller 610 and applies it to the application roller. The anilox roller 610 provides desirable metering of a fluid onto a substrate. In FIG. 6 there is an anticlockwise rotation of the anilox roller 610 as indicated by arrow 620. In other examples, the transfer member may comprise a non-cylindrical member and/or belt mechanism.

As may be derived from 7, the mounting brackets 120A and 120B and base 10, which form a mounting, are arranged to position the chamber in relation to the anilox roller 610 such that the aperture of the chamber 110 is a defined distance from a surface of the transfer member.

In one implementation, the bodies of the format limiters 350 are closest to the anilox roller 610; for example, an edge of each format limiter 350 may be spaced between 0.1 to 0.3 mm from the surface of the anilox roller 610. Despite this gap, the shape of each format limiter 350 and/or the use of a Teflon® construction can prevent fluid from the chamber from extending beyond the lateral edges of each format limiter 350. In effect the lateral edges of each format limiter 350 constrain fluid flow and act to define the aperture of the chamber 110. This results in fluid being deposited on the anilox roller 610 with a width equal to the width defined by the lateral end seals 220; in particular examples by a combination of the seals around the floating nuts 320 and the format limiters 350. Hence, the adjustable width of the chamber 110 allows fluid to be deposited onto areas of the anilox roller surface with varying widths. In turn, this allows efficient transfer of fluid to print media and substrates of various formats and/or sizes. For example, fluid as deposited onto the surface of the anilox roller 610 with a particular area width is transferrable from the surface to a substrate following the rotation of the anilox roller 610, e.g. the substrate may be driven by a media transport to a location tangential to the anilox roller 610 where transfer can occur.

As dimensions of the print medium vary, the width of the chamber 110 can be adapted. The fluid can thus be applied in correct amounts and precisely along the width of the print medium, while not extending beyond its edges. A surplus of a fluid could damage other components of the printing system because of its aggressive nature, or by drying up and clogging certain components.

In certain implementations, aperture size is matched to fluid speed and anilox linear speed, i.e. the linear speed of the tangential surface of the anilox roller. In one case, the apparatus is configured such that fluid velocity in the gap between upper and lower housing portions is at least twice the value of the anilox linear velocity. In one implementation the gap between upper and lower housing portions is 0.4 mm, but it could be a number of different sizes depending on the dimensions of the apparatus and/or the printing system.

As is indicated in FIG. 7, due to the design of the chamber 110 there is a low pressure fluid zone beyond the aperture of the chamber. Within the chamber 110 there is a high pressure fluid zone, e.g. due to the supply of fluid under pressure to the fixed volume of the chamber and/or the inward movement of the lateral end seals 220.

As can be seen in FIG. 7, the projection 450 of the upper housing portion 160A extends towards the surface of the anilox roller 610 and forms an upper edge of the low pressure fluid zone. The fluid from the chamber attaches to the projection 450 of the upper housing portion as it flows on towards the anilox roller. As can be seen in FIG. 7, the projection 450 does not contact the surface if the anilox roller 610 in this example.

In one example, fluid is supplied to the supply nozzles 130 during use. In this case the majority of the pressure drop in the apparatus is across the aperture region. This allows laminar fluid flow from the aperture.

Below the projection 450 of the upper housing portion 160A is a doctor blade 650. A doctor blade may be a thin elongate member that substantially extends along the length of the anilox roller 610. It has the function of diverting fluid excesses away from the anilox roller 610. An area of a doctor blade may be in communication with a fluid tank such that excess fluid can be removed and possibly reused within the apparatus. In the example of FIG. 7, the doctor blade 650 is located below the projection 450 and forms a lower boundary to the low pressure liquid zone 630. As the doctor blade 650 is located below the format limiters 350, as can be seen in FIG. 7, there is no format spreading, e.g. due to the configuration of the apparatus a curtain of fluid maintains its width as it descends from the aperture under pressure and/or gravity forces to the doctor blade tip.

In the example of FIG. 7, the format limiters 350 do not contact the surface of the anilox roller 610, i.e. as described above there is a defined spacing between the apparatus 100 and the transfer member. As the apparatus 100 is fixed in place via the mounting brackets 120 and is contactless, this enables tangential movement of the anilox roller 610, e.g. upward and downward from the perspective of FIG. 7. This can be achieved without affecting any fluid "beading" areas where fluid passes from the chamber 110 to the surface of the anilox roller 610.

In one implementation, the anilox roller 610 may transfer fluid deposited on the surface thereon to a rubber application roller. In this case, the contactless arrangement may allow the anilox roller 610 to be disconnected from the application roller by way of a tangential movement, e.g. upwards or downwards. For example, the anilox roller 610 may be mounted on a pivoted arm that is moveable via a further linear actuator such as a pneumatic or hydraulic piston. This movement may then allow fluid transfer to the application roller to stop. This can control format length, e.g. the length of a cut substrate. Hence, in this case, control of print media with varying heights and widths is achievable. This allows fluid application off-roll, e.g. to a variety of cut substrates. For example, to prevent fluid from being applied to a substrate beyond the end of a cut length the anilox roller 610 may be displaced vertically in FIG. 7, such that at a subsequent time coincident with the end of the substrate passing the application roller, fluid would no longer pass to the application roller and thus the substrate. Control of anilox roller engage/disengage timing may be performed by computer so as to match substrate length. Such control can be configured based on one or more of the geometry, timings and inertia ratio of the moving parts of the printing system.

In a variation of the above case, the anilox roller may have two working positions and one service position. In a first, main, working position the anilox roller is in a contact with an application roller and transfers a certain fluid volume to the application roller. The apparatus is located by adjustment screws tangentially to the anilox roller in manner such that the anilox roller is able to freely move upward. The format limiters may have a shape corresponding to the curve of the anilox roller in order to avoid a significant gap where fluid could escape. In a second, semi-engaged, working position, the anilox roller moves upward a certain distance. This stops fluid transfer to an application roller. Finally, in a service position, the anilox roller lifts up a further distance and allows system cleaning and maintenance.

A number of examples and variations are described above. It should be noted that certain described features may be extracted from the described examples and used independently to achieve an effect in a printing system. Moreover, omission, replacement and addition of features is envisaged. This may occur depending on particular factors of implementation.

In certain described examples, fluid format control is achieved, enabling control of fluid application to substrates that vary in width and/or length. Certain examples similarly provide one or more efficient design features that enable fluid format control in a minimal time period and/or with minimal operator intervention. Certain examples and/or features described herein may reduce downtime in a printing system such as a printing press, reduce fluid contamination of surrounding areas and/or simplify maintenance. For example, the lack of contact with the anilox roller can reduce maintenance by avoiding significant wear.

Certain examples described herein are useful for sheet fed delivery techniques that requires, for example, liquid or primer application inside a substrate format. Substrate format could be any paper size in a given range; for example, in one case the apparatus may support a variable format width from 410 mm to 760 mm and a variable format length from 297 mm up to 535 mm. This is particularly useful for thin substrates, wherein an over wetting of substrate edges by a fluid can cause paper deformation. It is also useful for short print runs where it is useful to change primer application area with substrate format (e.g. width and length, i.e. values in a process dimension and a lateral dimension).

Certain examples described herein relate to apparatus and methods. In a method case, certain techniques described above may be applied, either using the described apparatus or another apparatus.

The preceding description has been presented only to illustrate and describe examples of the principles described. In certain Figures similar sets of reference numerals have been used to ease comparison of similar and/or comparative features. Variations are described herein, in places as features of examples. For example, the apparatus may be extended to a duplex system, any of the seals described herein including the piston and/or aperture seals may be constructed from Teflon® or a material with analogous properties. In a duplex system an arrangement comprising apparatus 100, anilox roller 610 and an application roller may be mirrored, with a first arrangement mounted above a media transport path and a second arrangement mounted below the media transport path, each arrangement being configured to apply a fluid to a respective side of a substrate. In certain cases at least one of the lateral seals comprises a format limiter arranged laterally in relation to the aperture and a mounting is arranged to position the format limiter a defined distance from the surface of the transfer member such that the transfer member may be moved tangentially without contacting the format limiter. The term print medium or substrate may refer to a discrete medium, e.g. a page of paper or material, or a continuous medium, e.g. a roll of paper or vinyl. This description is not intended to be exhaustive or to limit these principles to any precise form disclosed. Many modifications and variations are possible in light of the above teaching

What is claimed is:

1. A seal to move along a slit, comprising:

a first leaf;

a second leaf; and a biasing member to push the first leaf away from the second leaf, and to push the second leaf away from the first leaf, and wherein the biasing member is a V-shaped shim arranged between the first leaf and the second leaf.

2. The seal of claim 1, wherein the V-shaped shim is glued to the first leaf and the second leaf.

3. The seal of claim 1, further comprising a shim stopper between the first leaf and the second leaf.

4. The seal of claim 1, wherein the V-shaped shim is a folded V-shaped shim to push the first and second leafs away from one another.

5. The seal of claim 4, wherein the folded V-shaped shim comprises:

a first member in contact with the first leaf, a second member in contact with the second leaf, wherein a space is provided between the first and second members.

6. The seal of claim 5, wherein the first and second members are angled away from one another and are connected to one another by a connecting portion of the folded V-shaped shim.

7. The seal of claim 4, wherein the folded V-shaped shim comprises polyamide.

8. An apparatus for applying a fluid to a medium in a printing system, comprising:

a chamber to receive the fluid, the chamber comprising a housing, an aperture, and lateral seal assemblies, the aperture being defined between the lateral seal assemblies and having an upper edge and a lower edge, wherein at least one of the lateral seal assemblies is moveable along an axis of the chamber toward one another or away from one another to adjust a width of the aperture, and wherein the movable lateral seal assembly comprises an aperture seal arranged to move along the aperture, the aperture seal comprising an upper leaf and a lower leaf, wherein the upper leaf is pushed into contact with the upper edge and the lower leaf is pushed into contact with the lower edge.

9. The apparatus of claim 8, wherein the chamber has a cross-section, wherein the cross-section has a drop shape with a semi-circular portion and a tapering portion, the aperture being formed at an apex of the tapering portion.

10. The apparatus of claim 9, comprising an upper wing arranged above an upper side of the tapering portion, and a lower wing arranged below a lower side of the tapering portion.

11. The apparatus of claim 10, wherein the housing comprises an outer housing and a flexible inner sheet arranged on an inside of the outer housing to protect the outer housing from the fluid.

12. Apparatus according to claim 11, wherein the flexible inner sheet is attached to the upper wing and to the lower wing.

13. A printing system comprising:

an apparatus to apply a fluid to a medium according to claim 8, and further comprising a transfer member to transfer the fluid from the apparatus to the medium, and wherein the transfer member comprises a roller.

14. The printing system of claim 13, wherein the fluid is a primer fluid.

15. The apparatus of claim 8, wherein the aperture seal comprises a V-shaped shim between the upper leaf and the lower leaf, the V-shaped shim to push the upper leaf into contact with the upper edge, and the V-shaped shim to push the lower leaf into contact with the lower edge.

16. The apparatus of claim 15, wherein the V-shaped shim comprises:

a first member in contact with the first leaf, a second member in contact with the second leaf, wherein a space is provided between the first and second members.

17. An apparatus for applying a fluid to a medium in a printing system, comprising:

a chamber to receive the fluid, the chamber comprising a housing, an aperture, and lateral seal assemblies, the aperture being defined between the lateral seal assemblies and having an upper edge and a lower edge, wherein at least one of the lateral seal assemblies is moveable along an axis of the chamber to adjust a width of the aperture, and wherein the movable lateral seal assembly comprises an aperture seal arranged to move along the aperture, the aperture seal comprising an upper leaf and a lower leaf, wherein the upper leaf is pushed into contact with the upper edge and the lower leaf is pushed into contact with the lower edge, and wherein the moveable lateral seal assembly comprises a piston seal arranged to move within the housing.

18. The apparatus of claim 17, wherein the moveable lateral seal assembly is operatively connected with a seal linear actuator arranged to drive the movable lateral seal assembly along the axis of the chamber.

19. The apparatus of claim 18, wherein the seal linear actuator comprises a lead screw coupled to a motor and a floating nut moveable along the axis of the chamber.

* * * * *